United States Patent [19]

Thermet et al.

[11] Patent Number: 5,039,438

[45] Date of Patent: Aug. 13, 1991

[54] USE OF AMINES WITH POLYFLUORINATED CHAIN AS LUBRICANT ADDITIVES

[75] Inventors: Robert Thermet, Plaisir; Marc Hermant, Cormeilles en Parisis; Jean-Michel Martin, Ecully; Dominique Basset, Poissy, all of France

[73] Assignee: Atochem, France

[21] Appl. No.: 56,286

[22] Filed: May 29, 1987

Related U.S. Application Data

[63] Continuation of Ser. No. 763,886, Aug. 8, 1985, abandoned, which is a continuation of Ser. No. 534,993, Aug. 19, 1983, abandoned.

[30] Foreign Application Priority Data

Jan. 22, 1982 [FR] France ..... 82 00964

[51] Int. Cl.[5] ..... C10M 105/50; C10M 105/56

[52] U.S. Cl. ..... 252/51; 252/51.5 R; 252/42.7; 252/33.4

[58] Field of Search ..... 252/51, 51.5 R, 33.4, 252/42.7

[56] References Cited

U.S. PATENT DOCUMENTS

| | | | |
|---|---|---|---|
| 2,572,066 | 10/1951 | Smith | 252/51 X |
| 2,616,927 | 11/1952 | Kauck et al. | 252/51 X |
| 2,691,036 | 10/1954 | Miller | 252/51 X |
| 2,861,990 | 11/1958 | Cleaver et al. | 252/51 X |
| 2,915,471 | 12/1959 | Lorensen | 252/51 X |
| 3,227,761 | 1/1966 | De Brunner et al. | 252/51 X |
| 3,822,209 | 7/1974 | Knapp et al. | 252/51 X |
| 3,873,619 | 3/1975 | Foulletier et al. | 260/563 R |
| 4,059,629 | 11/1977 | Foulletier et al. | 260/583 GG |

FOREIGN PATENT DOCUMENTS

| | | |
|---|---|---|
| 1532284 | 7/1968 | France . |
| 2102753 | 4/1972 | France . |

OTHER PUBLICATIONS

Smalheer, C. V. et al., "Lubricant Additives", 1967, pp. 2–6, Detergents, Dispersants.

*Primary Examiner*—Margaret B. Medley

*Attorney, Agent, or Firm*—Brooks Haidt Haffner & Delahunty

[57] ABSTRACT

Methods for improving the anti-friction and wear-reducing properties of lubricating oils by adding to such oils polyfluoro chain-containing amines of the formula

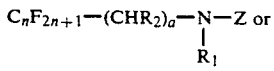

$$C_nF_{2n+1}-(CHR_2)_a-\underset{\underset{R_1}{|}}{N}-Z \text{ or}$$

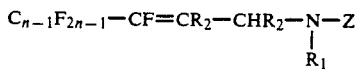

$$C_{n-1}F_{2n-1}-CF=CR_2-CHR_2-\underset{\underset{R_1}{|}}{N}-Z$$

or the commercially available mixtures of such materials, wherein n is an integer from 1 to 20, a is two or four, $R_2$ is hydrogen or a lower alkyl group, and $R_1$ and Z are:

When Z is hydrogen, $R_1$ is hydrogen or an alkyl group having from one to six carbon atoms, an aryl radical, or an alicyclic radical having from three to ten carbon atoms, or $R_1$ and Z are selected from alkyl radicals having from one to six carbon atoms, or Z is

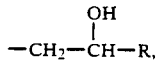

$$-CH_2-\overset{\overset{OH}{|}}{C}H-R,$$

while $R_1$ is hydrogen, an alkyl group having from one to six carbon atoms, or

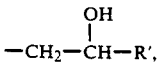

$$-CH_2-\overset{\overset{OH}{|}}{C}H-R',$$

R and R' being hydrogen or methyl, or $R_1$ and Z together form a linear alkylene group containing from three to ten carbon atoms, and lubricating oils containing such polyfluoro chain-containing amines and "ash-free" or organometallic dispersant/detergent additives.

8 Claims, No Drawings

USE OF AMINES WITH POLYFLUORINATED CHAIN AS LUBRICANT ADDITIVES

This application is a continuation of application Ser. No. 763,886, filed Aug. 8, 1985 now abandoned, which is a continuation of application Ser. No. 534,993, filed Aug. 19, 1983, also now abandoned.

BACKGROUND OF THE INVENTION

The present invention relates to using organo-fluoro products comprising an amine or aminoalcohol function and a polyfluorinated chain as friction- and wear-reducing additives, and more particularly, it relates to the use of amino compounds with a polyfluorinated chain as soluble additives in lubricating oils in conjunction with conventional detergent/dispersant additives included in compounded oils for gasoline and diesel engines.

The use of certain organo-fluoro derivatives as additives in lubricant compositions is known. For instance, the use of salts of aliphatic amines and perhalogenated monocarboxylic acids is described in U.S. Pat. No. 3,565,926. Also, the use of derivatives obtained by reacting an aromatic amine and a fluorinated organic compound selected from the fluorinated saturated carboxylic monoacids or the fluorinated monocarboxylic acid chlorides is disclosed in French Patent No. 2,026,493. However, these carboxylic derivatives have the disadvantage of losing their anti-wear properties in the presence of ordinary additives such as dispersant/detergent additives, either as a result of physicochemical interactions which impede their absorption by the surfaces which are to be lubricated or as a result of chemical interactions, particularly when the dispersant/detergent additives are neutral or superbasic alkaline earth metal salts. To the same effect, the publication of Kapsa et al, *ASME Trans.* 103, 486–496 (1981) mentions the harmful interaction of zinc dialkyldithiophosphates with conventional dispersant/detergent additives consisting of superbasic calcium sulfonates.

THE INVENTION

It has now been discovered that the addition to lubricants of amines or of aminoalcohols having polyfluorinated chains in conjunction with certain dispersant/detergent additives results in lubricant compositions having remarkable anti-wear properties and a friction reducing ability superior to those described in the prior art. Moreover, this is obtained without any harmful interactions.

Briefly, the lubricant additives used according to the present invention are fluoro compounds of general formula:

$$C_nF_{2n+1}-(CHR_2)_a-\underset{\underset{R_1}{|}}{N}-Z \qquad \text{(I)}$$

or $$C_{n-1}F_{2n-1}-CF{=}CR_2-CHR_2-\underset{\underset{R_1}{|}}{N}-Z \qquad \text{(II)}$$

or mixtures of fluoro compounds of general formulas (I) and (II). In the formulas herein, $C_nF_{2n+1}$ and $C_{n-1}F_{2n-1}$ represent straight-chained or branched perfluoro chains wherein n is an integer from 2 to 20. In the case of the mixtures of fluoro compounds of general formulas (I) and (II), $C_nF_{2n+1}$ and $C_{n-1}F_{2n-1}$ represent homologous perfluoro chains. Further, in the present formulas, $R_2$ is hydrogen or a lower alkyl radical containing from one to three carbon atoms; a is 2 or 4; $R_1$ and Z correspond to the following definitions:

Z is a hydrogen atom and $R_1$ is a hydrogen atom or an alkyl radical containing from one to six carbon atoms, an aryl radical or a cyclic radical having three to ten carbon atoms; or $R_1$ and Z are the same or different alkyl radicals containing from one to six carbon atoms, or Z is the group

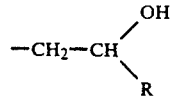

and $R_1$ is hydrogen, or Z is an alkyl radical having one to six carbon atoms or the group

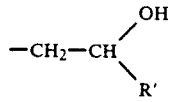

wherein R and R' represent either a hydrogen atom or a methyl group, $CH_3$—, or $R_1$ and Z together form a straight-chained alkylene radical having three to ten carbon atoms.

In certain embodiments of this invention, the additives according to this invention are desirably commercial products containing at least 10 parts per hundred of a fluoro compound of formula (I). These products and the mixtures thereof are prepared by the methods described in French Patent No. 1,532,284 and the Certificates of Addition thereto, and in French Patents Nos. 1,588,865 and 2,031,650.

In general, it is preferred to add at least 0.01 parts per hundred of the additive to the lubricating oil. In certain preferred embodiments, from about 0.05 to about 0.5 parts per hundred of additive is used. All parts, percentages, proportions, and ratios herein are by weight unless otherwise indicated.

The lubricating oil treated according to this invention includes a mineral oil, a synthetic hydrocarbon, a synthetic oil belonging to the following different groups: glycols, glycol ethers, glycol esters, polyoxyalkylene glycols, the ethers and esters thereof, and the esters of monocarboxylic or polycarboxylic acids and monoalcohols or polyalcohols. It will be appreciated from the present description that other oils can also be improved according to the present invention.

When petroleum fractions intended for the production of motor oils, such as the "Neutral Solvent" bases, are used as the lubricant base, the organo-fluoro derivatives according to this invention are preferably combined with conventional dispersant/detergent additives such as alkylsulfonates and calcium or barium alkylphenates, or "ash-free" dispersants such as succinic derivatives. The dispersant/detergent additives promote the dissolution or dispersion of the fluoro additives in the oil without affecting the anti-wear properties of the additives and without diminishing their own capability.

The addition of the fluoro derivatives according to this invention to formulated oils already containing dispersant/detergent additives selected from the organo-metallic derivatives (such as, for example, calcium or barium alkyl phenates and neutral or superbasic calcium or barium sulfonates) and so-called "ash-free" additives results in a substantial improvement in the anti-wear quality and an increase in the load capacity of the oils, without interfering with the properties imparted by the other additives (particularly, dispersivity, detergency, and anti-corrosive activity).

Replacing the zinc dithiophosphate used as an anti-wear additive with 0.1 to 0.2 parts per hundred of the present organo-fluoro derivatives in oil formulations for internal combustion engines makes it possible to obtain a degree of protection against wear which is equal to or greater than that obtained with the conventional additive.

The amines or aminoalcohols containing polyfluoro chains according to this invention are thus used as anti-wear and friction-reducing additives, either as replacements for zinc alkyldithiophosphates in lubricating oils for gasoline or diesel engines, or in addition thereto in these same oils.

The following Examples are given to illustrate embodiments of the invention as it is presently preferred to practice it. It will be understood that these Examples are illustrative, and the invention is not to be considered as restricted thereto except as indicated in the appended claims.

In the following Examples, commercial products consisting of mixtures of saturated derivatives and ethylenic derivatives containing, unless otherwise specified, 30 to 50 parts per hundred of ethylenic derivatives and 70 to 50 parts per hundred of saturated derivatives are used. In these mixtures, the products are described in their saturated form.

EXAMPLES I–VII

The anti-wear quality of the perfluoro chain-containing amino compounds of this invention in pure lubricant bases is demonstrated by tests carried out on a tribometer with plane-to-plane contact geometry, the basic plan of which is shown in the journal article in *Wear*, 53, 10 (1979). This friction machine brings one flat surface into contact with another flat surface. To do this, a ring of treated 100 C6 steel is applied to two circular tracks 1 cm wide machined on a lamellar graphitic cast iron disc. The load is applied to the ring by the cone of a rotating tip. The ring can thus rotate freely about its axis of revolution when put under stress.

The contact thus produced has an apparent surface area of about 10 $mm^2$. The mean contact pressure is 0.8 GPa for an applied load of 80 daN, and the linear sliding velocity is between 40 and 60 mm/sec. The tests are carried out at 80° C. and the wear is measured by Vickers microhardness indentation.

The results obtained with different compositions containing dodecane as the lubricant base are given in Table I. The measurements were made after 100 revolutions and are expressed in $\mu$m.

As a comparison, the results obtained with pure dodecane, with dodecane containing 1 part per hundred of zinc di-n-butyldithiophosphate, and with dodecane containing 0.1 parts per hundred of carboxylic acid salts with fluoro chains and of di(2-ethylhexyl)amine are also given (Examples I to IV).

TABLE I

Wear on a plane-to-plane tribometer
100 C6 steel on cast iron, 80° C., 80 daN, 1000 revolutions

| Examples | Composition | Wear ($\mu$m) |
|---|---|---|
| I | Dodecane | >7 |
| II | Dodecane + 1% ZnDTP | 0.6 |
| III | Dodecane + 0.1% $C_7F_{15}COOH$, di(2EH)A | 1 |
| IV | Dodecane + 0.1% $C_8F_{17}C_2H_4COOH$, di(2EH)A | 0.9 |
| V | Dodecane + 0.1% $C_8F_{17}C_2H_4N(C_2H_4OH)_2$ | 0.9 |
| VI | Dodecane + 0.1% $C_8F_{17}C_2H_4NHC_2H_4OH$ | 0.4 |
| VII | Dodecane + 0.1% $C_8F_{17}(C_2H_4)_2N(C_2H_4OH)_2$ | 0.9 |

ZnDTP is zinc di-n-butyldithiophosphate containing about 10% of a mineral oil.
di(2EH)A is di(2-ethylhexyl)amine.

EXAMPLES VIII–XVIII

The overall friction-reduction of polyfluoro-chain amino derivatives in pure lubricant bases is determined by tests carried out on a tribometer with a sphere-to-plane configuration, the basic plan of which is shown in the journal article in *Wear*, 53, 10 (1979).

The tribometer simulates the contact of the piston ring with the cylinder wall in the vicinity of top dead center of an internal combustion engine. A hemispherical rubbing, with hardened steel, the radius of curvature being 6 mm, is applied to a flat plate of lamellar graphitic cast iron and moves in an alternating movement thereon at a speed of 1 mm/sec, the length of travel being 10 mm. The load applied to the friction member is 1 daN, corresponding to a Hertzian pressure of 6 GPa. During each test, a quantity of lubricant is introduced onto the contact surface. The whole apparatus is heated to 80° C. and the stabilized dynamic coefficient of friction $\mu$ is measured. The results obtained with different compositions containing dodecane as the lubricant base are given in Table II.

As a comparison (Examples VIII to XII) the results obtained with pure dodecane, dodecane containing 1 part per hundred of zinc di-n-butyldithiophosphate (ZnDTP), dodecane containing 1 part per hundred of molybdenum dialkyldithiophosphate (MoDTP), dodecane containing 0.1 parts per hundred of carboxylic acid salts with fluoro chains and di(2-ethyl-hexyl)amine [di(-2EH)A] are given. It will be seen that the addition of 0.1 parts per hundred of certain amino derivatives with polyfluoro chains to a mineral base reduces the friction to a level equal to, or even lower than, that obtained with 1 part per hundred of molybdenum dialkyldithiophosphate, which is regarded as the most effective additive in its field.

TABLE II

Friction on a sphere-to-plane tribometer
100 C6 steel on cast iron, 80° C., 1 daN

| Examples | Composition | Coefficient of friction $\mu$ |
|---|---|---|
| VIII | Dodecane | 0.20 |
| IX | Dodecane + 1% ZnDTP | 0.11 |
| X | Dodecane + 1% MoDTP | 0.06 |
| XI | Dodecane + 0.1% $C_7F_{15}COOH$,di(2EH)A | 0.08 |

TABLE II-continued

| Examples | Composition | Coefficient of friction μ |
|---|---|---|
| | Friction on a sphere-to-plane tribometer 100 C6 steel on cast iron, 80° C., 1 daN | |
| XII | Dodecane + 0.1% $C_8F_{17}C_2H_4COOH$,di(2EH)A | 0.08 |
| XIII | Dodecane + 0.1% $C_2F_5C_2H_4NHC_2H_4OH$ | 0.08 |
| XIV | Dodecane + 0.1% $C_6F_{13}C_2H_4NHC_2H_4OH$ | 0.04 |
| XV | Dodecane + 0.1% $C_8F_{17}C_2H_4NHC_2H_4OH$ | 0.05 |
| XVI | Dodecane + 0.1% $C_6F_{13}C_2H_4N(C_2H_4OH)_2$ | 0.04 |
| XVII | Dodecane + 0.1% $C_8F_{17}C_2H_4N(C_2H_4OH)_2$ | 0.06 |
| XVIII | Dodecane + 0.1% $C_{10}F_{21}C_2H_4N(C_2H_4OH)_2$ | 0.06 |

ZnDTP is zinc di-n-butyldithiophosphate containing about 10% of a mineral oil.
MoDTP is molybdenum dialkyldithiophosphate.
di(2EH)A is di(2-ethylhexyl)amine.

EXAMPLES XIX-XXVIII

The anti-wear property and load capacity of compositions containing 200 Neutral Solvent mineral oil as the base oil and the perfluoro chain amino compounds according to the invention as additives are determined by means of the Shell four-ball E. P. machine, described in "Annual Book of ASTM Standards, Part 24, pages 680 to 688, (1979)".

The anti-wear test consists of applying a constant load of 40 daN (70 daN in the case of Example XXIIbis) for one hour, and then measuring the diameters of the wear indentations on the three fixed balls.

The load capacity test comprises measuring the diameters of the wear indentations as a function of the load applied. The results are expressed as the Load Wear Index (L. W. I.). The operating conditions and the method of calculating the L. W. I. are described in ASTM Method 2783 71 T.

The results obtained are shown in Table III. As in the previous Examples, the results obtained with compositions containing either zinc di-n-butyldithiophosphate (ZnDTP or salts of carboxylic acids with polyfluoro chains and aliphatic amines are given as a comparison (Examples XX to XXIII). The aliphatic amines used were di(2-ethylhexyl)amine and Primene JM-T, a mixture of aliphatic amines with tertiary alkyl chains containing 18 to 24 carbon atoms.

TABLE III

| Examples | Composition | Test 1 hr at 40 daN Diameter of indentation, mm | L.W.I., daN |
|---|---|---|---|
| | Tests on Shell four-ball E.P. machine | | |
| XIX | 200 Neutral Solvent Oil | 0.98 | 19 |
| XX | +1% di-n-butyl ZnDTP | 0.46 | 33.2 |
| XXI | +0.1% $C_7F_{15}COOH$, di(2EH)A | 0.56 | 38 |
| XXII | +0.2% $C_7F_{15}COOH$, Primene JM-T | 0.51 | 45.8 |
| XXIII | +0.1% $C_6F_{13}C_2H_4COOH$, di(2EH)A | 0.49 | 45 |
| XXIV | +0.1% $C_5F_{11}-CF=CH-CH_2N$ ($CH_2-CH_2$, $CH_2-CH_2$) | 1.09 | 26.8 |
| XXV | +0.1% $C_7F_{15}-CF=CH-CH_2N(C_2H_5)_2$ | 0.98 | 27.1 |
| XXVI | +0.1% $C_4F_9C_2H_4N(C_2H_4OH)_2$ | 0.71 | 42.2 |
| XXVII | +0.05% $C_6F_{13}C_2H_4NHC_2H_4OH$ | 0.71 | 42 |
| XXVIII | +0.05% $C_8F_{17}C_2H_4N(C_2H_4OH)_2$ | 0.76 | 43 |
| XXIIbis | +0.2% $C_7F_{15}COOH$, Primene JM-T | Test 1 hr at 70 daN Diameter of indentation in mm 0.6 | |

For the preferred polyfluoro chain amino derivatives the increase in the load capacity of the 200 Neutral Solvent oil is of the same order as that obtained with carboxyl derivatives with polyfluoro chains By contrast, the anti-wear effect under the test conditions with the four-ball machine for one hour at 40 daN appears less marked with the amino derivatives with polyfluoro chains than with the carboxyl derivatives with polyfluoro chains.

The following Examples demonstrate that the combination of the polyfluoro chain amino derivatives with the dispersant/detergent additives belonging to the three main chemical families, alkyl sulfonates and alkyl phenates of neutral or basic alkaline earth metals and succinic derivatives, results in both an increase in the load capacity of the oils and an increase in the anti-wear effect, which is not the case with the carboxylic derivatives with fluoro chains in combination with the metal-containing dispersants/detergents.

EXAMPLES XXIX-XXXVI

The anti-wear quality and load capacity of compositions containing synthetic fluids as base oils and polyfluoro chain amino derivatives according to this invention as additives are determined, as in the preceding Examples, using the Shell fourball E. P. machine. The synthetic fluids used are diethylene glycol monoethyl ether, isooctanol adipate and two lubricant polyethers. Polyether 1, obtained by condensing propylene oxide with a mixture of monoalcohols containing an average of 14 carbon atoms, has a viscosity of 100 centistokes (cSt) at 40° C. Polyether 2, obtained by condensing a mixture of equal parts of ethylene oxide and propylene oxide with n-butanol, has a viscosity of 140 cSt at 40° C.

The results are given in Table IV and expressed as the Load Wear Index (L. W. I.) and the diameter of the wear indentations obtained after one hour's testing under constant loads of 40 daN and 70 daN.

TABLE IV

| Examples | Composition | Test on Shell four-ball E.P. machine: Test 1 hr at 40 daN Diameter of indentation (mm) | Test 1 hr at 70 daN Diameter of indentation (mm) | Load Wear Index |
|---|---|---|---|---|
| XXIX | Diethylene glycol monoethyl ether | 1.1 | | 18 |
| XXX | Diethylene glycol monoethyl ether + 0.2% $C_8F_{17}C_2H_4(C_2H_4OH)_2$ | 0.9 | | 25 |
| XXXI | Isooctyl adipate | 1.12 | | 20.5 |
| XXXII | Isooctyl adipate + 0.2% $C_8F_{17}C_2H_4N(C_2H_4OH)_2$ | 0.75 | | 29.6 |
| XXXIII | Polyether 1 | 0.6 | 1.93 | 34.7 |
| XXXIV | Polyether 1 + 0.2% $C_8F_{17}C_2H_4NHC_2H_4OH$ | 0.59 | 0.7 | 43 |
| XXXV | Polyether 2 | 0.56 | 0.63 | 44.4 |
| XXXVI | Polyether 2 + 0.2% $C_8F_{17}C_2H_4(C_2H_4OH)_2$ | 0.37 | 0.44 | 55.1 |

EXAMPLES XXXVII–XLVIII

The good compatibility of the polyfluoro chain amino derivatives of this invention with the metal-containing dispersant/detergent additives and the ash-free dispersant/detergent additives is demonstrated, on the one hand, in dodecane by means of tests in a tribometer of plane-to-plane configuration as described in Examples I to VII, and on the other hand by tests in the Shell 4-ball E. P. machine, namely, wear tests lasting one hour at 70 daN and load capacity tests (determination of the Load Wear Index) as described in

Examples XIX–XXVIII.

Table V shows the results obtained for wear in a tribometer of plane-to-plane construction with, on the one hand, solutions in dodecane of four dispersant/detergent additives (Examples XXXVII to XL) and, on the other hand, with these same solutions further containing the carboxylic derivative $C_8F_{17}C_2H_4COOH$ neutralized by di(2-ethylhexyl)amine (Examples XLI to XLIV) or the amine derivative $C_8F_{17}C_2H_4NHC_2H_4OH$ (Examples XLV to XLVIII).

The dispersant/detergents used for these tests are additives marketed under the following names: Additives 1 and 4 are Oloa 218A and Oloa 4373A (registered trademarks of Orogil), and additives 2 and 3 are sold by Lubrizol-France under the names Lubrizol LZ52 and Lubrizol LZ72.

TABLE V

| Composition | Wear on plane-to-plane tribometer (μm) Interaction with the dispersant/detergent additives: 5% calcium phenate 1 | 3% neutral calcium sulfonate 2 | 3% superbasic calcium sulfonate 3 | 5% succinic derivative 4 |
|---|---|---|---|---|
| Examples XXXVII–XL: Dodecane | ≧6.8 | ≧6.8 | 0.85 | 0.85 |
| Examples XLI–XLIV: Dodecane + 0.1% $C_8F_{17}C_2H_4COOH$,di(2EH)A | ≧6.8 | ≧6.8 | ≧6.8 | 0.92 |
| Examples XLV–XLVIII: Dodecane + 0.1% $C_8F_{17}C_2H_4NHC_2H_4OH$ | 0.82 | 1.03 | 0.80 | 0.60 |

EXAMPLES XLIX–LXXIV

Table VI shows the results obtained for wear and load capacity in the Shell 4-ball E. P. machine with, on the one hand solutions of dispersant/detergent additives in 200 Neutral Solvent mineral oil and, on the other hand, these same solutions to which have been added 0.1 to 0.2% of polyfluoro chain amino derivatives or, by way of a comparison, carboxylic derivatives with polyfluoro chains. The carboxylic acids with polyfluoro chains are neutralized with di(2-ethylhexyl)amine or Primene JM-T.

TABLE VI

| Example | Composition based on 200 Neutral Solvent oil | Wear and load capacity in a Shell 4-ball E.P. machine Interaction with dispersant/detergent additives: Test 1 h at 70 daN Diameter of indentation in mm | Load Wear Index in daN |
|---|---|---|---|
| XLIX | + 5% Lubrizol DS 6 (Succinimide) | 1.3 | 24.3 |
| L | + 5% Lubrizol DS 6 (Succinimide) + 0.2% $C_7F_{16}$ COOH, Primene JM-T | 0.77 | 50.7 |
| LI | + 5% Lubrizol DS 6 (Succinimide) + 0.2% $C_6F_{13}C_2H_4COOH$, di(2EH)A | 0.75 | 43.4 |
| LII | + 5% Lubrizol DS 6 (Succinimide) + 0.2% $C_4F_9C_2H_4N(C_2H_4OH)_2$ | 0.87 | 41.8 |

TABLE VI-continued

Wear and load capacity in a Shell 4-ball E.P. machine
Interaction with dispersant/detergent additives

| Example | Composition based on 200 Neutral Solvent oil | Test 1 h at 70 daN Diameter of indentation in mm | Load Wear Index in daN |
|---|---|---|---|
| LIII | + 5% Lubrizol DS 6 (Succinimide) + 0.2% $C_6F_{13}C_2H_4NHC_2H_4OH$ | 1 | 53.5 |
| LIV | + 5% Lubrizol DS 6 (Succinimide) + 0.2% $C_6F_{13}C_2H_4N(C_2H_4OH)_2$ | 0.92 | 53.8 |
| LV | + 3% Oloa 246B (neutral sulfonate) | 2.83 | 34.8 |
| LVI | + 3% Oloa 246B (neutral sulfonate) + 0.2% $C_7F_{15}COOH$, Primene JM-T | 2.08 | 27.4 |
| LVII | + 3% Oloa 246B (neutral sulfonate) + 0.2% $C_6F_{13}C_2H_4NHC_2H_4OH$ | 0.55 | 44.6 |
| LVIII | + 3% Oloa 246B (neutral sulfonate) + 0.2% $C_6F_{13}C_2H_4N(C_2H_4OH)_2$ | 0.75 | 43.8 |
| LIX | + 3% Oloa 246B (neutral sulfonate) + 0.2% $C_8F_{17}C_2H_4NHC_2H_4OH$ | 0.66 | 53.4 |
| LX | + 3% Oloa 246B (neutral sulfonate) + 0.2% $C_8F_{17}C_2H_4N(C_2H_4OH)_2$ | 0.55 | 43.8 |
| LXI | + 3% Oloa 247B (superbasic sulfonate) | 1.91 | 30.4 |
| LXII | + 3% Oloa 247B (superbasic sulfonate) + 0.2% $C_7F_{15}COOH$, Primene JM-T | 1.93 | 29.3 |
| LXIII | + 3% Oloa 247B (superbasic sulfonate) + 0.2% $C_8F_{13}C_2H_4NHC_2H_4OH$ | 0.84 | 45.3 |
| LXIV | + 3% Oloa 247B (superbasic sulfonate) + 0.2% $C_6F_{13}C_2H_4N(C_2H_4OH)_2$ | 0.83 | 44.9 |
| LXV | + 3% Oloa 247B (superbasic sulfonate) + 0.2% $C_8F_{17}C_2H_4NHC_2H_4OH$ | 0.88 | 53.9 |
| LXVI | + 3% Oloa 247B (superbasic sulfonate) + 0.2% $C_8F_{17}C_2H_4H(C_2H_4OH)_2$ | 0.91 | 53.6 |
| LXVII | + 3% LZ72 (superbasic sulfonate) | 2.02 | 29.3 |
| LXVIII | + 3% LZ72 (superbasic sulfonate) + 0.1% $C_6F_{13}C_2H_4COOH$, di(2EH)A | 2.02 | 24.9 |
| LXIX | + 3% LZ72 (superbasic sulfonate) + 0.1% $C_8F_{17}C_2H_4NHC_2H_4OH$ | 1.15 | 41.7 |
| LXX | + 5% Oloa 218A (Phenate) | 1.16 | 26.8 |
| LXXI | + 5% Oloa 218A (Phenate) + 0.2% $C_7F_{15}COOH$, Primene JM-T | 1.94 | 30.4 |
| LXXII | + 5% Oloa 218A (Phenate) + 0.2% $C_2F_5C_2H_4NHC_2H_4OH$ | 0.5 | 43.5 |
| LXXIII | + 5% Oloa 218A (Phenate) + 0.2% $C_6F_{13}C_2H_4NHC_2H_4OH$ | 0.79 | 54.4 |
| LXXIV | + 5% Oloa 218A (Phenate) + 0.2% $C_6F_{13}C_2H_4N(C_2H_4OH)_2$ | 0.86 | 55.3 |

The results given in this Table demonstrate the good compatibility of the polyfluoro chain amino derivatives with dispersant/detergent additives, either ash-free or metal-containing, whereas monocarboxylic derivatives with polyfluoro chains lose their properties in the presence of alkaline earth metal sulfonates and phenates.

EXAMPLES LXXV–LXXXI

The additive used is a combination of a polyfluoro chain amino derivative and metal-containing dispersant/detergents. A synergistic effect is observed which is demonstrated by the results (Table VII) of the wear tests lasting one hour under a load of 70 daN carried out on the Shell 4-ball E. P. machine.

TABLE VII

Wear test on a Shell 4-ball E.P. machine. Synergistic effect between $C_8F_{17}C_2H_4NHC_2H_4OH$ and dispersant/detergents

| Examples | Compositions based on 200 Neutral Solvent oil | 1 hr test at 70 daN Diameter of indentation, mm |
|---|---|---|
| LXXV | + 0.2% $C_8F_{17}C_2H_4NHC_2H_4OH$ | 0.99 |
| LXXVI | + 3% Oloa 246B | 2.83 |
| LXXVII | + 3% Oloa 247B | 1.91 |
| LXXVIII | + 3% LZ52 (neutral sulfonate) | 1.97 |
| LXXIX | { + 0.2% $C_8F_{17}C_2H_4NHC_2H_4OH$ + 3% Oloa 246B | 0.66 |
| LXXX | { + 0.2% $C_8F_{17}C_2H_4NHC_2H_4OH$ + 3% Oloa 247B | 0.88 |
| LXXXI | { + 0.2% $C_8F_{17}C_2H_4NHC_2H_4OH$ + 3% LZ52 | 0.65 |

EXAMPLES LXXXII-LXXXIX

The results of these Examples show that the amino derivatives with polyfluoro chains remain effective, not only in the presence of the dispersant/detergent additives but also when they are combined with the other conventional additives included in the formulation of oils for internal combustion engines, such as anti-freeze agents, viscosity index improvers, anti-oxidant and anti-corrosion additives, and anti-wear additives. The tests on wear and load capacity were carried out with the Shell 4-ball E. P. machine under conditions identical to those in the tests in Examples LXXV to LXXXI.

Table VIII shows the results obtained by adding 0.2% polyfluoro chain amino derivatives to an SAE 15W-40 oil for gasoline engines containing all the conventional additives included in the composition of this type of lubricant, apart from the anti-wear agent zinc dialkyldithiophosphate. These results are compared with those obtained with a complete SAE 15W-40 oil, i.e., containing 1% zinc dialkyldithiophosphate. The main additives to this SAE 15W-40 oil are polymethacrylates as anti-freeze agents and viscosity index improver additives and succinimides as dispersant/detergents.

TABLE VIII

| Examples | Wear and load capacity in a Shell 4-ball E.P. machine Compatibility with an engine oil without ZnDTP: Compositions based on SAE 15W-40 without ZnDTP | Test 1 hr at 70 daN Diameter of indentation, mm | Load Wear Index in daN |
|---|---|---|---|
| LXXXII | SAE 15W-40 without ZnDTP | 1.19 | 30.4 |
| LXXXIII | SAE 15W-40 without ZnDTP + 0.2% $C_2F_5C_2H_4NCH_2H_4OH$ | 1.14 | 46.2 |
| LXXXIV | SAE 15W-40 without ZnDTP + 0.2% $C_4F_9C_2H_4H(C_2H_4OH)_2$ | 0.96 | 57.3 |
| LXXXV | SAE 15W-40 without ZnDTP + 0.2% $C_6F_{13}C_2H_4NHC_2H_4OH$ | 0.69 | 56.8 |
| LXXXVI | SAE 15W-40 without ZnDTP + 0.2% $C_8F_{17}C_2H_4NHC_2H_4OH$ | 0.55 | 46.5 |
| LXXXVII | SAE 15W-40 without ZnDTP + 0.2% $C_8F_{17}C_2H_4N(C_2H_4OH)_2$ | 0.66 | 48.5 |
| LXXXVIII | SAE 15W-40 without ZnDTP + 0.2% $C_7F_{15}COOH$, Primene JM-T | 1.43 | 44.4 |
| LXXXIX | SAE 15W-40 with ZnDTP | 0.72 | 50.2 |

EXAMPLES LXXXIX-XCVII

Table IX shows the effect of the amino derivatives with fluoro chains when added to complete oils, i.e., those containing all the additives for engine oils, including zinc dialkyldithiophosphates. The oils studied are, on the one hand, the SAE 15W-40 gasoline engine oil, described above, and, on the other hand, an SAE 20W-50 Diesel engine oil which contains, in addition to anti-freeze polymers and viscosity-improving agents, the conventional anti-wear, anti-corrosion and anti-oxidant additives, a polysuccinimide, and a basic calcium sulfonate as dispersant/detergents. The addition of 0.1% amino derivatives with fluoro chains significantly increases the anti-wear power of these oils. The increase in the Load Wear Index is shown by a substantial reduction in the diameter of the wear indentations under small loads and an increase in the incipient seizure load.

TABLE IX

| Examples | Wear and load capacity in a Shell 4-ball E.P. machine Effect on two complete oils | Test 1 hr at 70 daN Diameter of indentation, mm | Load Wear Index in daN |
|---|---|---|---|
| LXXXIX | SAE 15W-40 (Gasoline engines) | 0.72 | 50.2 |
| XC | " +0.2% $C_6F_{13}C_2H_4NHC_2H_4OH$ | 0.55 | 58.7 |
| XCI | " +0.2% $C_8F_{17}C_2H_4NHC_2H_4OH$ | 0.60 | 59 |
| XCII | " +0.2% $C_6F_{17}C_2H_4N(C_2H_4OH)_2$ | 0.72 | 57.2 |
| XCIII | SAE 20W-50 (Diesel engines) | 0.86 | 41.3 |
| XCIV | " +0.2% $C_6F_{13}C_2H_4NHC_2H_4OH$ | 0.77 | 69.1 |
| XCV | " +0.2% $C_8F_{17}C_2H_4NHC_2H_4OH$ | 0.79 | 58.9 |
| XCVI | " +0.2% $C_8F_{17}C_2H_4(C_2H_4OH)_2$ | 0.89 | 69 |
| XCVII | " +0.2% $C_8F_{17}(C_2H_4)_2N$ ($CH_3$, $C_2H_4OH$) | 0.81 | 58 |

A comparison of Examples XXXVII to XL, respectively, with Examples XLV to XLVIII (according to the invention) and with Examples XLI to XLIV (according to Esso French Patent 2,026,493) shows that the addition, according to the invention, of detergent/dispersants to the claimed polyfluoro chain amines results in a synergistic effect, whereas the addition of these same detergent/dispersants to the organofluoro compound $C_8F_{17}C_2H_4COOH$, di(2EH)A according to French Patent 2,026,496 does not result in any improvement.

A comparison of Example XXII bis with Examples LV and LVI and with Examples LXI and LXII and with Examples LXX and LXXI (according to French Patent 2,026,496) shows that there is an antagonistic effect when the dispersant/detergent is added to the derivative of $C_7F_{15}COOH$ and Primene JM-T.

By contrast, the following comparisons:

Examples LXXV-LXXVI with Example LXXIX

Examples LXXV–LXVII with Example LXXX
Examples LXXV–LXXVIII with Example LXXXI show that the addition, according to the invention, of a dispersant/detergent (a neutral sulfonate and a superbasic sulfonate) to the claimed polyfluoro chain amines provides a synergistic effect.

These various Examples accordingly illustrate the unexpected nature of the invention.

What is claimed is:

1. A lubricating oil for internal combustion engines which oil contains at least one dispersant/detergent additive and an amount of a polyfluorochain-containing amine effective to reduce the friction of the oil and to increase its anti-wear properties, the polyfluoro chain-containing amine having the formula $$C_nF_{2n+1}-(CHR_2)_a-\underset{\underset{R_1}{|}}{N}-Z \text{ or}$$

$$C_{n-1}F_{2n-1}-CF=CR_2-CHR_2-\underset{\underset{R_1}{|}}{N}-Z$$

wherein $R_2$ is hydrogen or a lower alkyl group having one to three carbon atoms; n is an integer from 1 to 20; a is 2 or 4; the polyfluoro chains $C_nF_{2n+1}$ or $C_{n-1}F_{2n+1}$ are straight or branched, and Z is hydrogen, an alkyl group containing from one to six carbon atoms, 2-hydroxyethyl, or 2-hydroxypropyl; $R_1$ is hydrogen, an alkyl group containing from one to six carbon atoms, an aryl group, a cycloalkyl group having three to ten carbon atoms, 2-hydroxethyl, or 2-hydroxypropyl; or Z and $R_1$ together form an alkylene group having from three to ten carbon atoms, the two ends of which alkylene group are bonded to the nitrogen atom, Z being hydrogen when $R_1$ is alkyl or cycloalkyl.

2. A method for improving the anti-friction and anti-wear properties of lubricating oils which method comprises adding to a lubricating oil containing at least one dispersant/detergent additive in an effective amount of at least about 0.01 percent by weight of the lubricating oil to improve the properties of the oil of at least one polyfluoro chain-containing amine having the formula $$C_nF_{2n+1}-(CHR_2)_a-\underset{\underset{R_1}{|}}{N}-Z \text{ or}$$

$$C_{n-1}F_{2n-1}-CF=CR_2-CHR_2-\underset{\underset{R_1}{|}}{N}-Z$$

wherein $R_2$ hydrogen or a lower alkyl group having one to three carbon atoms; n is an integer from 1 to 20; a is 2 or 4; the polyfluoro chains $C_nF_{2n+1}$ or $C_{n-1}F_{2n+1}$ are straight or branched, and Z is hydrogen, an alkyl group containing from one to six carbon atoms, 2-hydroxethyl, or 2-hydroxypropyl; $R_1$ is hydrogen, an alkyl group containing from one to six carbon atoms, an aryl group, a cycloalkyl group having three to ten carbon atoms, 2-hydroxyethyl, or 2-hydroxypropyl; or Z and $R_1$ together form an alkylene group having from three to ten carbon atoms, the two ends of which alkylene group are bonded to the nitrogen atom, Z being hydrogen when $R_1$ is alkyl or cycloalkyl.

3. A method according to claim 1 wherein the oil contains an organometallic dispersant/detergent.

4. A method according to claim 1 wherein the oil contains a so called overbased metallic dispersant/detergent.

5. A method according to claim 1 wherein the oil contains an "ash-free" dispersant/detergent.

6. A method according to claim 1 wherein the amount of polyfluoro chain-containing amine is from 0.1 to 0.2 parts per hundred of the oil.

7. A method according to claim 2 wherein the polyfluoro chain-containing additive is present in an amount of from about 0.01 to about 0.5 percent by weight of the lubricating oil.

8. A method according to claim 2 wherein the polyfluoro chain-containing additive is present in an amount of from about 0.05 to about 0.5 percent by weight of the lubricating oil.

* * * * *